US008241061B2

(12) United States Patent
Chazottes et al.

(10) Patent No.: US 8,241,061 B2
(45) Date of Patent: Aug. 14, 2012

(54) OBTURATOR FOR A COMPARTMENT OF A JUNCTION UNIT AND JUNCTION UNIT EQUIPPED WITH SUCH A OBTURATOR

(75) Inventors: Frédéric Chazottes, Houx (FR); Christian Campfort, Fresnay le Gilmert (FR)

(73) Assignee: FCI Automotive Holding, Guyancourt (FR)

( * ) Notice: Subject to any disclaimer, the term of this patent is extended or adjusted under 35 U.S.C. 154(b) by 0 days.

(21) Appl. No.: 12/223,013

(22) PCT Filed: Jan. 19, 2006

(86) PCT No.: PCT/FR2006/000138

§ 371 (c)(1),
(2), (4) Date: Jan. 21, 2009

(87) PCT Pub. No.: WO2007/083003

PCT Pub. Date: Jul. 26, 2007

(65) Prior Publication Data

US 2009/0305569 A1 Dec. 10, 2009

(51) Int. Cl.
*H01R 13/40* (2006.01)

(52) U.S. Cl. ..... 439/587; 439/272; 439/746

(58) Field of Classification Search ..... 439/587, 439/589, 272, 746
See application file for complete search history.

(56) References Cited

U.S. PATENT DOCUMENTS

| | | | | |
|---|---|---|---|---|
| 4,941,847 | A * | 7/1990 | Welsh | 439/595 |
| 4,973,266 | A * | 11/1990 | Bullard | 439/589 |
| 5,551,892 | A * | 9/1996 | Endo et al. | 439/587 |
| 5,707,251 | A | 1/1998 | Sakai et al. | 439/589 |
| 6,071,147 | A * | 6/2000 | Tsukamoto | 439/587 |
| 6,247,965 | B1 * | 6/2001 | Cummings et al. | 439/587 |
| 6,325,669 | B1 * | 12/2001 | Safai | 439/587 |
| 6,390,848 | B1 | 5/2002 | Murakami et al. | 439/587 |
| 6,485,332 | B1 * | 11/2002 | Kwang | 439/587 |
| 6,814,632 | B1 * | 11/2004 | Peterson | 439/877 |
| 7,618,287 | B2 * | 11/2009 | Hass | 439/589 |

FOREIGN PATENT DOCUMENTS

EP 0 964 482 A1 12/1999

* cited by examiner

*Primary Examiner* — Truc Nguyen
(74) *Attorney, Agent, or Firm* — Harrington & Smith

(57) ABSTRACT

The subject of the invention is a plug for a socket of a connector housing including a sealing front part with a mat-seal equipping the rear of connector housing, and a rear part defining a zone for holding the plug in a rear passage of the connector housing, front part and rear part being connected by a transition zone.

16 Claims, 4 Drawing Sheets

Figure 4:
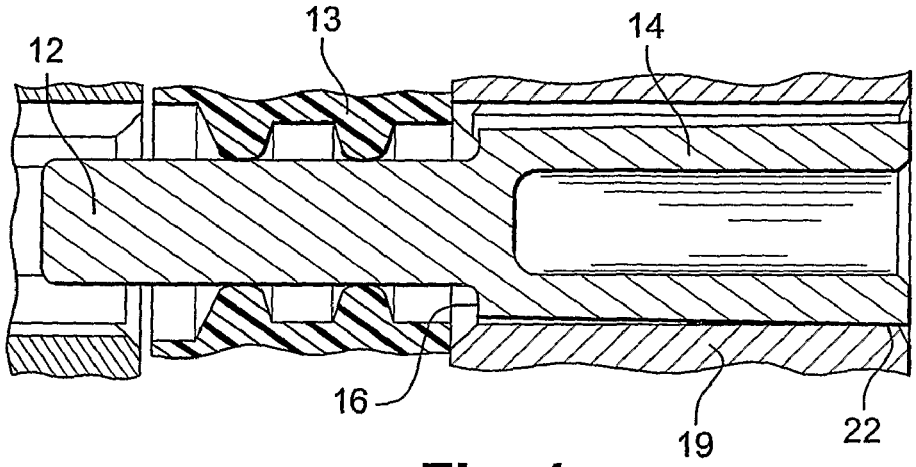

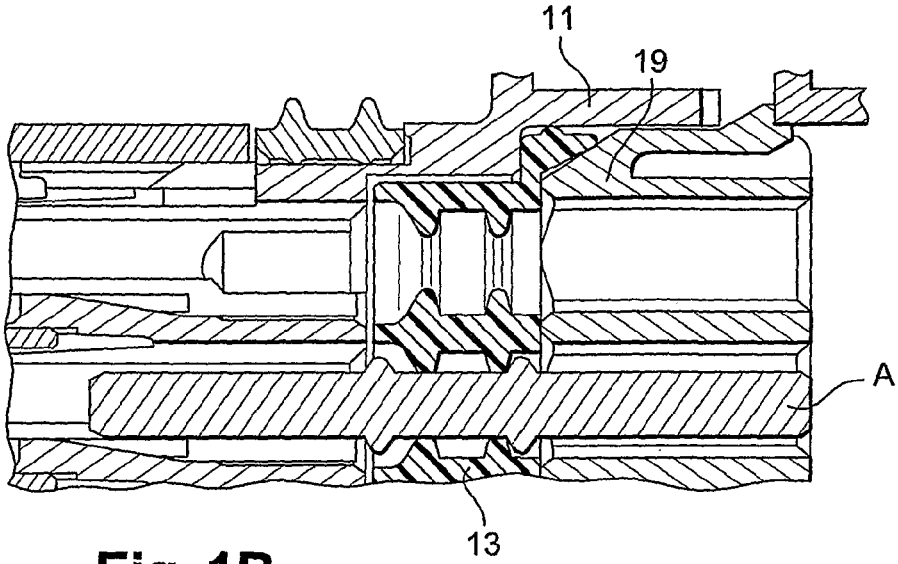
Fig. 1B
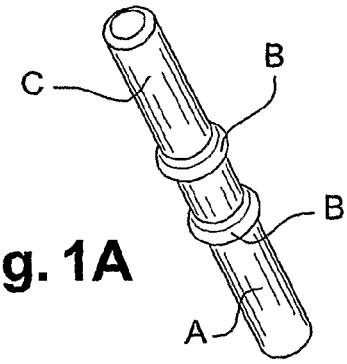
Fig. 1A
Fig. 3
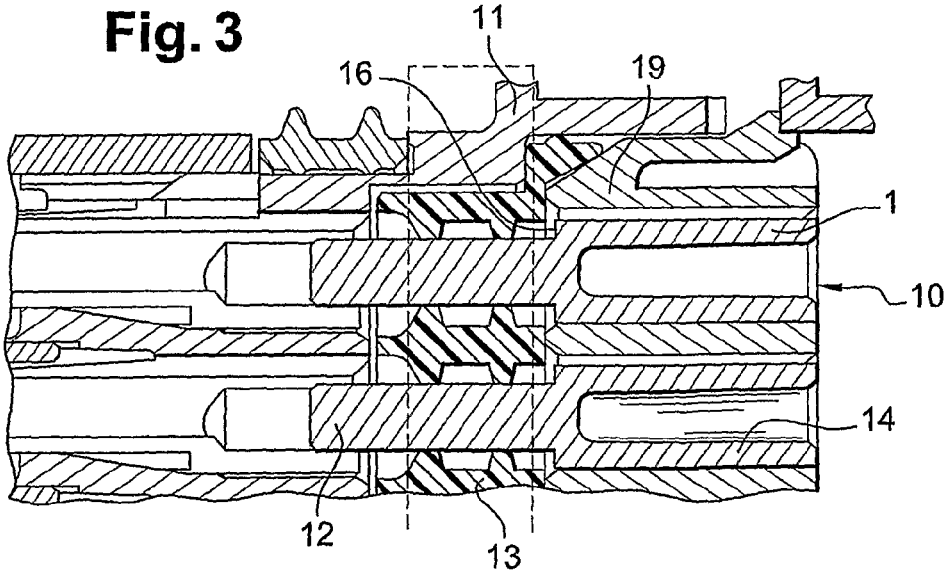

Fig. 2A
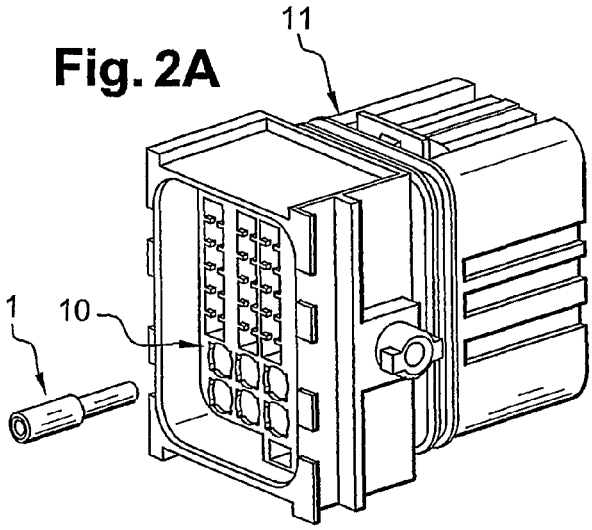
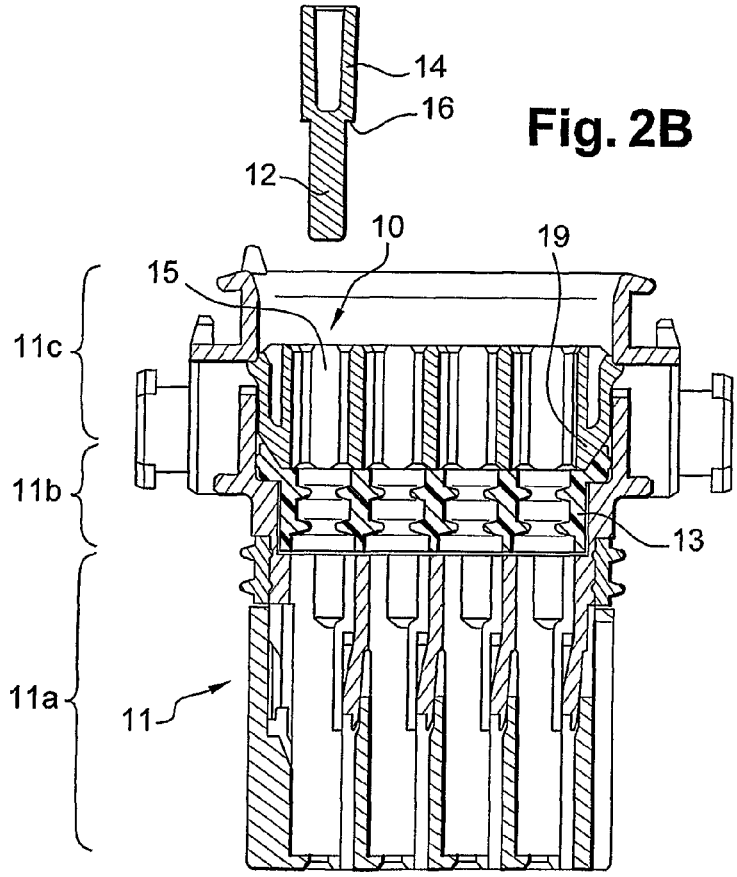
Fig. 2B
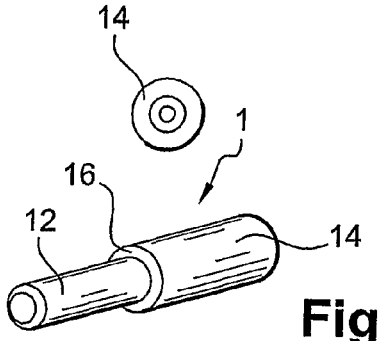
Fig. 2C

OBTURATOR FOR A COMPARTMENT OF A JUNCTION UNIT AND JUNCTION UNIT EQUIPPED WITH SUCH A OBTURATOR

The present invention concerns a plug for maintaining the seal of sealed connectors that are not completely filled with contacts and cables, this plug being installed in the free sockets of these connectors.

These plugs must be easy to manufacture and inexpensive, while offering a good seal throughout the life of the connector, and they must be reliably held in the sockets.

Plugs designed to be inserted into free sockets of sealed electrical connector housings currently exist, and FIG. 1A shows such a plug of the prior art.

The plug according to this figure is a cylindrical plug made of thermoplastic that has annular shoulders for retention of the plug, which come to be positioned on either side of the sealing mat-seal positioned at the rear of the connector housing when the plug is introduced into the socket.

These shoulders require molding the plug with a mold that has a mold-opening surface along a longitudinal axis of the plug, which leads to the existence of longitudinal flash along the outer face of the plug.

This flash is found in the zone that assures the seal between the mat-seal and the plug, and creates the risk of leaks throughout the service life of the connector.

Moreover, the correct positioning of the plug of the prior art is obtained when the shoulders are arranged on either side of the lips of the mat-seal, and if the plug is not properly positioned, the connector may not be correctly sealed.

The present invention seeks to create a plug that offers a good seal over time, is easy to insert, and is firmly retained in the socket of the connector housing.

To do this, the present invention first provides a plug for a socket of the connector housing, having a sealing front part with a mat-seal equipping the rear of the connector housing, and a rear part defining a zone for holding the plug in a rear passage of the connector housing, the front part and the rear part being joined by a transition zone.

Moreover, the invention concerns an electrical connector housing equipped with at least one plug received in a rear passage of connector sockets.

Preferably, the plug is held in the socket by elastic deformation of the rear part of the plug. Alternatively, it could be held by elastic deformation of the rear passage of the housing.

The rear passage is preferentially an opening in a rear grid for passage of cables and for holding the mat-seal.

In particular, the opening of the rear grid and the rear part of the plug have different sections in order to create pointwise contact zones between the surface of the plug and the wall of the grid opening.

Figure 5:
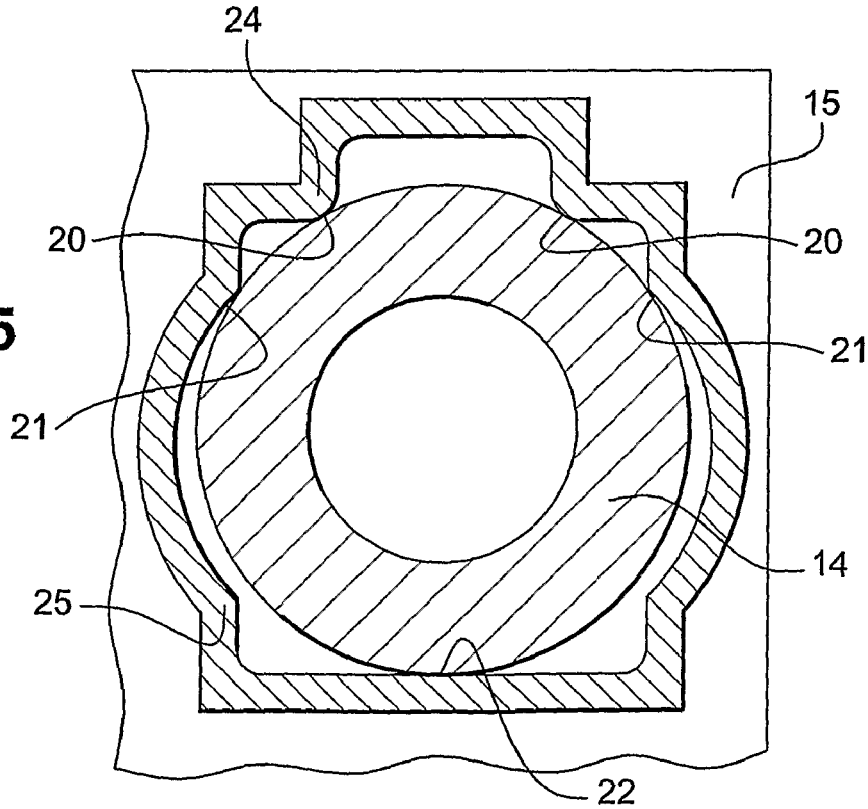

Other characteristics and advantages of the invention will be better understood upon reading the description of a non-limiting example of embodiment of the invention accompanied by drawings, which show:

in FIGS. 1A and 1B: a plug of the prior art, in perspective and in section, received in a connector housing, respectively;

in FIGS. 2A, 2B and 2C: perspective and sectional views of a first embodiment of a plug according to the invention, combined with a connector housing;

in FIG. 3: a sectional view of one part of the connector housing equipped with plugs according to the invention;

in FIG. 4: an enlarged view of FIG. 3;

in FIG. 5: a rear view of the connector housing of FIG. 3 looking at a socket opening equipped with a plug according to FIG. 2C;

in FIGS. 6A, 6B, 6C, 6D: alternative embodiments of plugs according to the invention.

The present invention concerns a sealing plug designed to be inserted into a socket of a connector housing when this socket is not equipped with a contact and a cable coupled to this contact.

A plug A of the prior art is shown in FIG. 1A. This thermoplastic plug has two annular shoulders B for holding the plug, which, when the plug is introduced into the socket, come to be positioned on either side of sealing mat-seal 13 positioned at the rear of connector housing 11, as shown in FIG. 1B.

Due to its geometry, molding such a plug requires a two-part mold that allows longitudinal flash C to form on the outer surface of the plug.

This flash hinders the seal between the plug and the mat-seal.

Moreover, as seen above, a correct positioning of the plug of the prior art is obtained when the shoulders are positioned right up against either side of the lips of the mat-seal and the rear part of this plug does not participate in its retention.

If the plug is inserted with too much force, it may be pushed in too far, causing the rear annular shoulder of the plug to pass between the lips of the mat-seal, which will reduce the seal between the plug and mat-seal.

A first example of embodiment of plug 1 according to the present invention is shown in FIGS. 2A and 2B, together with a connector housing designed to receive it, and in FIG. 2C, a view of the sealing front part of the plug in a lateral perspective, and a front view.

According to the example, housing 11 is a housing designed to be coupled with a complementary housing, not shown, and designed to receive electrical contacts on cables leaving from the rear of the housing, as is also known. Plugs according to the invention serve to plug into sockets not equipped with cables and contacts, so as to maintain the seal of an under-equipped connector.

Plug 1 according to the invention finds application, for example, in the case of a sealed automobile connector provided to receive several cables of bundles, including optional cables according to the version of the vehicle.

For an under-equipped vehicle, there are connector sockets that lack cables and contacts, so that for the life of the vehicle, it is necessary to plug up these empty sockets.

Housing 11 viewed in section in FIG. 2B comprises a front part 11*a* for holding contacts, a recessed middle part 11*b* in which a mat-seal 13 is placed and a rear part made up of a skirt receiving a grid 19 for holding the mat-seal.

According to the example shown, the grid is a separate grid that inserts into the housing on top of the mat-seal and closes the rear of the housing, but it is possible to consider a grid that is part of an element of the rear housing or of one piece with the housing.

Plug 1 is inserted through the grid and bears a front sealing part 12 with mat-seal 13 equipping the rear of housing 11.

According to the example, front part 12 of the plug is smooth and cylindrical and is inserted between the lips of mat-seal 13 so as to create a tight barrier with these lips.

The plug according to the invention also comprises a rear part 14 defining a zone for holding the plug by compression in a rear passage 15 of the connector housing and made up of the holes of the grid, the compression being obtained by elastic deformation of rear part 14 of the plug.

The plug is compressed between the inner wall of rear passage 15 and the outer surface of rear part 14 of the plug.

Finally, according to the example, front part 12 and rear part 14 are joined by a transition zone 16.

In order to create a stop for the introduction of the plug into socket 10 receiving it, this transition zone bears a step-back, so that the diameter of rear part 14 at the level of the transition zone is greater than the diameter of front part 12.

According to the example, in order to adjust the resistance to insertion and the holding force of the plug, rear part 14 is made hollow in order to permit a deformation of the plug in its part in contact with the inner wall of the rear passage.

Again, according to the example, rear part 14 is generally slightly conical with an increasing diameter away from transition zone 16. This generally conical shape of rear part 14 of the plug permits a progressive increase of the compression force as the plug is pushed into rear passage 15 that extends the socket, so as not to resist the insertion of the plug too strongly.

One of the advantages of the present solution is to dissociate the means creating the seal and the means creating the retention of the plug.

According to the invention, the seal is made on the front part of the plug and the force for insertion and holding the plug is created an the rear of the plug.

By placing retention at the rear of the plug, one advantage of the invention is to permit adapting the profile for holding the plug as a function of the profile of the rear passage and the characteristics of the rear wall.

By adapting the shape of the rear part of the plug as a function of the configuration of the grid openings, the insertion and holding forces can be optimized.

According to this principle, FIGS. 6A to 6D show several possible variants of the invention adapted to the profiles of the rear passage of various sockets.

Figure 6A:
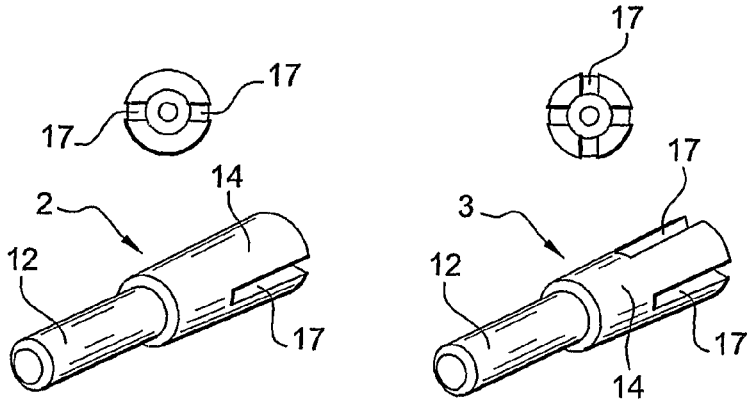

According to FIG. 6A, the rear part of plugs 2, 3 has a circular section, and at least the distal end of rear part 14 bears grooves 17. According to the example shown, two or four grooves are created.

These grooves facilitate compressing the rear part of the plug when it is introduced into a rear passage, notably a cylindrical passage; they limit the insertion forces while procuring a radial elastic recoil that assures effective retention.

Figure 6B:
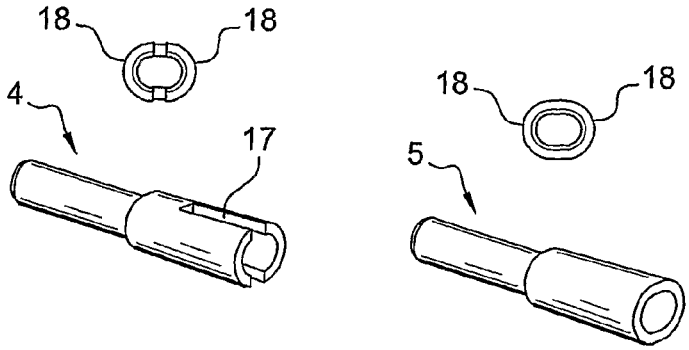

According to FIG. 6B, at least the distal end of plugs 4, 5 is oval. Plug 5 is also provided with grooves 17.

Such plugs are particularly useful for rectangular rear passages, so as to limit the contact zones of the plug with the wall of rear passage 15.

Figure 6C:
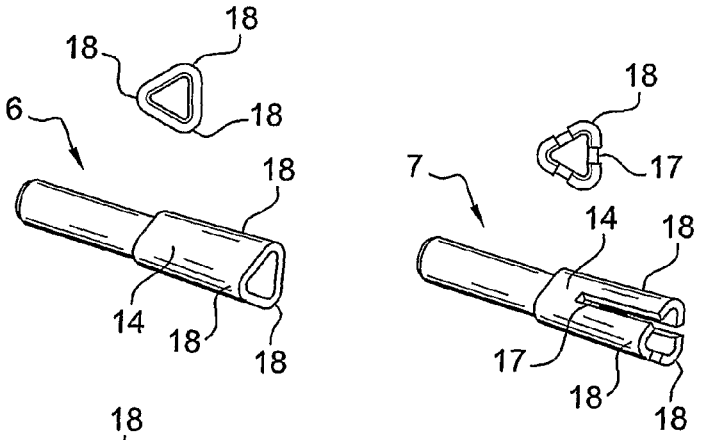
Figure 6D:
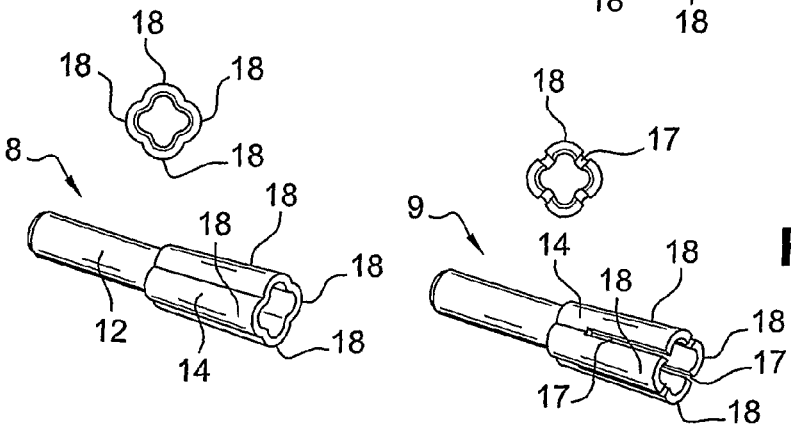

According to FIGS. 6C and 6D, rear part 14 of plugs 6, 7, 8, 9 bears raised pieces 18, directed toward the outside and relating to a revolution shape. The plugs of FIG. 6C have a general triangular section with three raised pieces for the plug according to reference 6 and three grooves 17, as well as three raised pieces 18 for the plug according to reference 7.

Plugs 8 and 9 of FIG. 6D, for their part, bear four raised pieces, these raised pieces being separated by four grooves for the plug according to reference 9.

These latter geometries of the holding part of plugs are particularly suitable in the case of circular passages 15, or passages of complex shape, in order to obtain a weak insertion force while conserving a strong force for holding the plug in the socket.

Rear passage 15 of the connector housing shown in FIG. 2B is an opening of a rear grid 19 of the housing that assures the retention of the mat-seal and a guiding of the cables at the connector outlet so that the cables do not laterally constrain the mat-seal and reduce the connector seal.

The openings of this rear grid may have a shape suitable to pre-guide the contact when it is introduced into housing 11 or to create a fool-proofing device to force the contact to be inserted according to only one orientation.

Thus, according to the different embodiments of plugs according to the invention, rear passage 15 and rear part 14 of the plug are each provided so as to have different contour shapes, suitable for creating discontinuous contact zones 20, 21, 22 between the outer surface of the plug and the wall surrounding the rear passage in the grid.

In particular, according to FIG. 5, passage 15 bears recessed corners 24 and 25.

It is advantageous to take advantage of these corners so as to create limited and discontinuous contact zones with the rear part of the plug, and in this case it would be preferable for this rear part to have a tubular shape of revolution, like that of the example of FIG. 2C.

In such a configuration, the sectional view of FIG. 4 shows the contact zone referenced by 22 in FIG. 5.

In this configuration, the part diametrically opposite the plug is free from contact with the wall of the passage created in grid 19.

Retention by multiple zones on the distal end of the rear part of the plug assures an effective wedging of the plug in the socket at a great distance from sealing front part 12, so as not to create any damaging constraint on this sealing front part or on the lips of the mat-seal.

The invention is not limited to the examples shown, and in particular, the distal end of the rear part of the plug may be provided with a collar totally plugging up the socket, without exceeding the scope of the invention.

The invention claimed is:

1. An electrical connector comprising:

a housing;

a mat seal connected to the housing, the mat seal comprising a plurality of cavities;

a rear grid connected to the housing, the rear grid comprising a plurality of passageways; and at least one thermoplastic plug located in one of the cavities of the mat seal, where the thermoplastic plug is a single one-piece member, wherein the thermoplastic plug comprises a front part and a rear part, wherein the front part creates a seal with the mat seal, and wherein the rear part defines a zone holding the thermoplastic plug in one of the passageways of the rear grid, where the rear part is at least partially hollow, where the rear part is elastically deformed inward into the hollow by the rear grid, where the elastic deformation of the rear part into the hollow results in the rear part exerting an outward holding force against the rear grid in the passageway.

2. The electrical connector of claim 1, wherein the front part and the rear part are joined by a transition zone.

3. The electrical connector of claim 1, wherein retention of the rear part in the passageway is obtained by elastic deformation.

4. The electrical connector of claim 1, wherein the front part is smooth and cylindrical.

5. The electrical connector of claim 2, wherein the transition zone comprises a step-back, and wherein a diameter of the rear part at a level of the transition zone is greater than a diameter of front part.

6. The electrical connector of claim 2, wherein the rear part has a generally slightly conical shape with an increasing diameter starting from the transition zone.

7. The electrical connector of claim 1, wherein at least a distal end of the rear part has grooves.

8. The electrical connector of claim 1, wherein at least a distal end of the rear part includes, in relation to a form of revolution, bulges directed outward.

9. An electrical connector comprising:

a housing;

a mat seal comprising a plurality of cavities;

a rear grid which is sized and shaped to be connected to the housing with the mat seal located between portions of the housing and the rear grid, wherein the rear grid comprises a plurality of passageways adapted to be aligned with the cavities of the mat seal; and a thermoplastic plug which is sized and shaped to be located in a first one of the cavities of the mat seal, where the thermoplastic plug is a single one-piece member, wherein the thermoplastic plug comprises a front part and a rear part, wherein the front part is configured to create a seal with the mat seal in the first cavity, and wherein the rear part defines a zone configured to contact the rear grid in a first one of the passageways and thereby mechanically hold the thermoplastic plug in the first passageway of the rear grid, where the rear part is at least partially hollow and the rear part is resiliently deformed inward into the hollow by the rear grid, where the elastic deformation of the rear part into the hollow results in the rear part exerting an outward holding force against the rear grid in the first passageway.

10. The electrical connector of claim 9 wherein the front part and the rear part are joined by a transition zone.

11. The electrical connector of claim 9 wherein retention of the rear part in the passageway is obtained by elastic deformation.

12. The electrical connector of claim 9 wherein the front part is smooth and cylindrical.

13. The electrical connector of claim 10 wherein the transition zone comprises a step-back, and wherein a diameter of the rear part at a level of the transition zone is greater than a diameter of front part.

14. The electrical connector of claim 10 wherein the rear part has a generally slightly conical shape with an increasing diameter starting from the transition zone.

15. The electrical connector of claim 9 wherein at least a distal end of the rear part has grooves.

16. The electrical connector of claim 9 wherein at least a distal end of the rear part includes, in relation to a form of revolution, bulges directed outward.

* * * * *